US005332396A

United States Patent [19]

Kaneko et al.

[11] Patent Number: 5,332,396

[45] Date of Patent: Jul. 26, 1994

[54] TERMINAL COVER STRUCTURE FOR CONNECTOR

[75] Inventors: Tohru Kaneko; Isao Kameyama, both of Shizuoka, Japan

[73] Assignee: Yazaki Corporation, Tokyo, Japan

[21] Appl. No.: 86,912

[22] Filed: Jul. 7, 1993

[30] Foreign Application Priority Data

Jul. 13, 1992 [JP] Japan ..... 4-185197

[51] Int. Cl.[5] ..... H01R 13/44

[52] U.S. Cl. ..... 439/141; 439/137

[58] Field of Search ..... 439/67, 77, 137, 140, 439/141, 147, 492, 493, 718

[56] References Cited

U.S. PATENT DOCUMENTS

| | | | |
|---|---|---|---|
| 4,445,739 | 5/1984 | Wooten | 439/140 |
| 4,474,420 | 10/1984 | Nestor | 439/77 X |
| 4,593,960 | 6/1986 | Millhimes et al. | 439/140 |
| 5,037,319 | 8/1991 | Hatagishi | 439/140 |
| 5,051,100 | 9/1991 | Kato et al. | 439/140 |
| 5,230,636 | 7/1993 | Masuda et al. | 439/140 X |

FOREIGN PATENT DOCUMENTS

| | | |
|---|---|---|
| 53-146982 | 11/1978 | Japan . |
| 56-29881 | 3/1981 | Japan . |

*Primary Examiner*—Khiem Nguyen

*Attorney, Agent, or Firm*—Armstrong, Westerman, Hattori, McLeland & Naughton

[57] ABSTRACT

In a connector whose exposed terminals are connected to a mating connector having a terminal portion of a flexible printed circuit, the invention provides a terminal cover structure which prevents terminals from being exposed when the connector is disconnected. The terminal cover structure has a slidable protective cover that protects the exposed terminals of the connector. With the protective cover retracted, the exposed terminals are brought into contact with the exposed terminal portion of the mating connector. Either of the protective cover or the mating connector is provided with an engagement portion which consists of resilient clamping pieces to draw out the protective cover. The other is provided with a second engagement portion that engages with the first engagement portion.

12 Claims, 5 Drawing Sheets

TERMINAL COVER STRUCTURE FOR CONNECTOR

BACKGROUND OF THE INVENTION

1. Field of the Invention

The present invention relates to a terminal cover structure for a connector whose exposed terminal is connected into a mating connector that has a terminal portion of a flexible printed circuit.

2. Description of the Prior Art

FIG. 8 shows the terminal cover structure of a conventional connector disclosed in the Japanese Utility Model Preliminary Publication No. Showa 53-146982.

In the figure, designated 30 is a male connector and 31 a junction box having a female connector portion 32 that receives the male connector 30.

The male connector 30 has exposed terminals 34 each having a resilient contact piece 33 that can protect outwardly. These exposed terminals 34 are covered by a slidable protective cover 35 that faces the resilient contact pieces 33. The protective cover 35 has engagement projections 36 near the front end which, when the protective cover 35 is slid up, engage with engagement grooves 39 formed in a cover engagement frame 38 of the connector housing 37.

The female connector portion 32 accommodates an exposed terminal portion 41 of a flexible printed circuit body 40. As the male connector 30 is inserted into the female connector portion 32, the protective cover 35 is pushed up, putting the exposed terminal portion 41 and the exposed terminal 34 of the male connector 30 into electrical contact with each other.

However, with the above-mentioned conventional structure, when the male connector 30 is pulled out as during maintenance work, the resilient contact piece 33 of the exposed terminal 34 is easily scored or damaged due to unwanted contact with adjacent objects because the protective cover 35 remains pushed up or open with the engagement projections 36 kept in engagement with the engagement groove 39.

SUMMARY OF THE INVENTION

The present invention has been accomplished with a view to overcoming the above drawbacks and its objective is to provide a terminal cover structure for a connector that can protect terminals even when the connector is disconnected during maintenance.

To achieve the above objective, the terminal cover structure for a connector according to this invention comprises: a protective cover provided on the connector, slidable in a direction parallel to an axis of the connector to be drawn out to cover exposed terminals of the connector or retracted; a first engagement means provided to one of the protective cover and a mating connector; and a second engagement means provided to the other of the the protective cover and the mating connector, the second engagement means adapted to engage with the first engagement means to draw out the protective cover; wherein electrical connection between the exposed terminals of the connector and terminals of the mating connector is made with the protective cover retracted and the connector is disconnected from the mating connector with the protective cover drawn out to protect the exposed terminals.

Since in the engaged condition of the connector, the first engagement portion made of resilient clamping pieces and the second engagement portion are engaged, when the connector is removed, the slidable protective cover is drawn out by the locking of the first and second engagement portion to cover the exposed terminals, followed by the resilient clamping pieces disengaging from the second engagement portion, allowing the connector to part from the mating connector.

DETAILED DESCRIPTION OF PREFERRED EMBODIMENT

Figure 1:
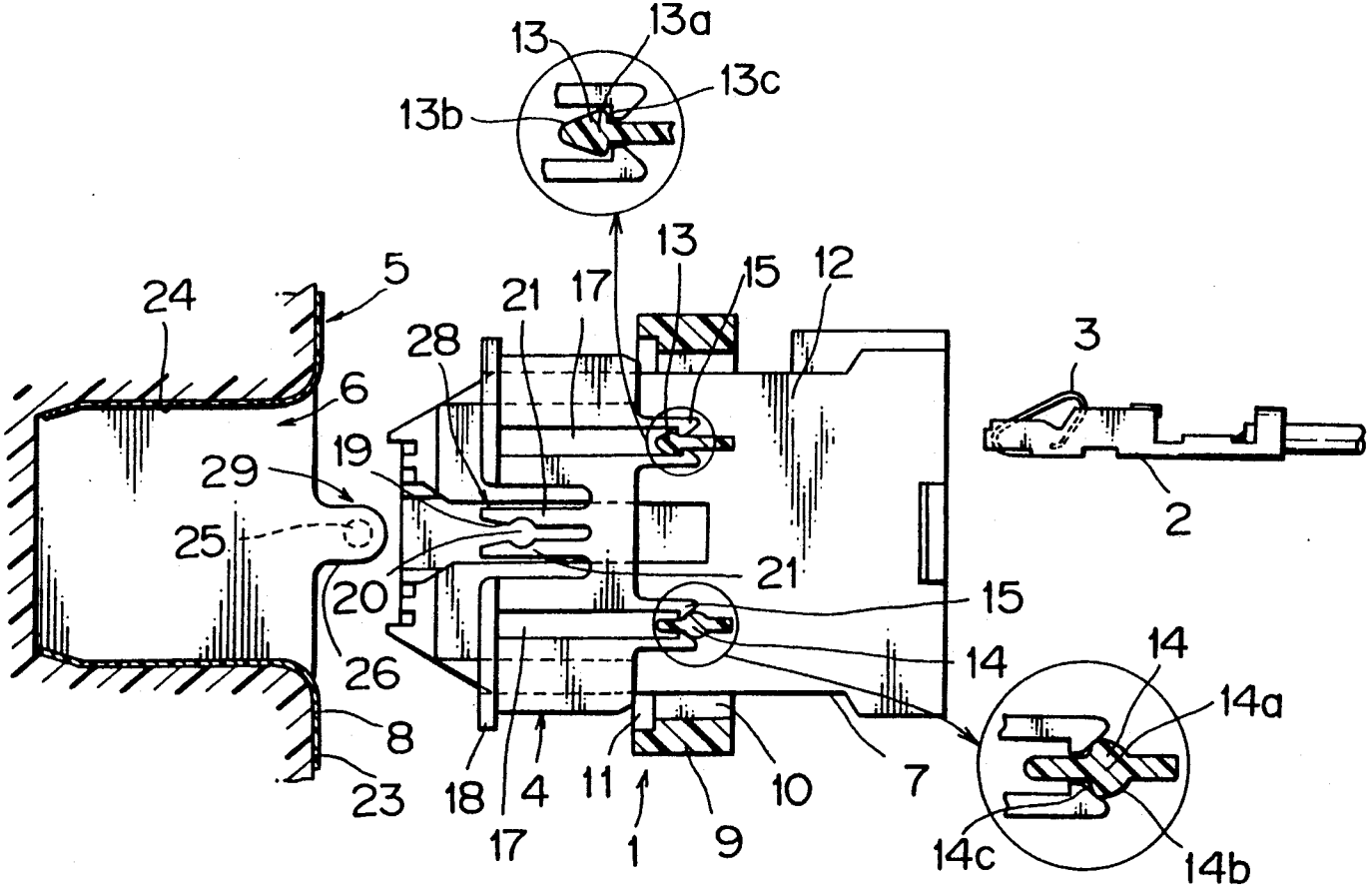
FIG. 1 is a vertical cross section of the terminal cover structure for a connector as one embodiment of the present invention before the connector is engaged.
Figure 2:
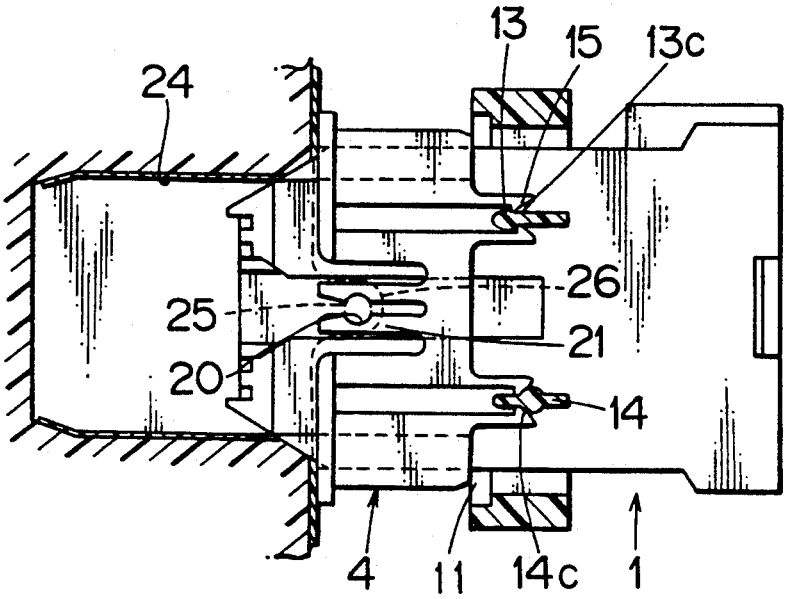
FIG. 2 is a vertical cross section of the terminal cover structure when the connector is in the process of being engaged.
Figure 3:
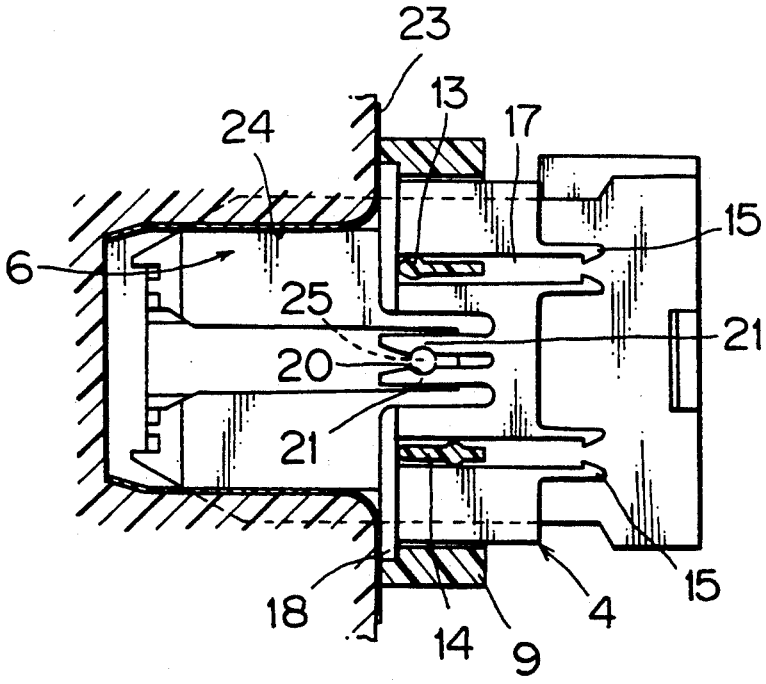
FIG. 3 is a vertical cross section of the terminal cover structure when the connector is in the engaged condition.
Figure 4:
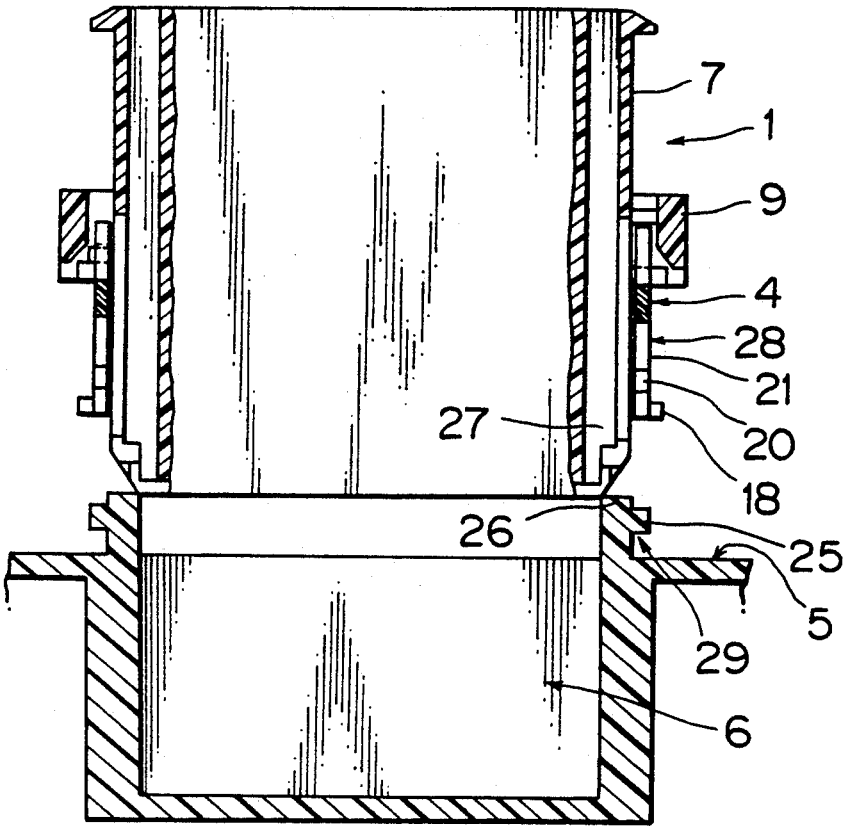
FIG. 4 is a lateral cross section of the terminal cover structure before the connector is engaged.

FIGS. 1 to 3 are vertical cross sections showing the terminal cover structure for a connector according to this invention in three different conditions that it assumes as the connector is engaged. FIG. 4 is a lateral cross section before the connector is engaged.

In these figures, denoted I is a male connector which accommodates an exposed terminal 2 having a resilient contact piece 3 covered by a slidable protective cover 4. Reference numeral 5 represents an automotive meter case having a female connector portion 6 to accept the male connector 1.

The resin housing 7 of the male connector 1 is integrally formed with an annular flange 9 that engages with the opening edge 8 of the female connector portion 6. At the inside of the annular flange 9 are formed a protective cover insertion space 10 and at the front a cover flange abutment groove 11. Inside the annular flange portion 9, the housing side walls 12 have two locking projections 13, 14 for the protective cover the locking projections 13, 14 including bulged portions **13*a*, 14*a*, respectively. One of the bulged portions 13*a* is slightly shifted forwardly from the other bulged portion 14*a* and is projected between a pair of flexible engagement claws 15, 15 of the protective cover 4 while the other slightly rearwardly located bulged portion 14*a* is simply pushed unengaged against the paired claws 15, thereby locking the protective cover 4** in the drawn-out position.

That is, as shown in the enlarged views in FIG. 1, the front bulged portion **13*a* is formed like an arrowhead with a moderate sloping surface 13*b* at the front and a vertical engagement surface 13*c* at the rear. The rear bulged portion 14*a*, conversely, has an engagement surface 14*c* at the front and a sloping surface 14*b* at the rear. Hence, the flexible engagement claws 15 of the cover 4 smoothly move along the sloping surface 13*b* of the front bulged portion 13*a* until they engage with the engagement surface 13*c*, while at the same time the claws 15 are reliably stopped by the engagement surface 14***c* of the rear bulged portion 14*a*.

Figure 5:
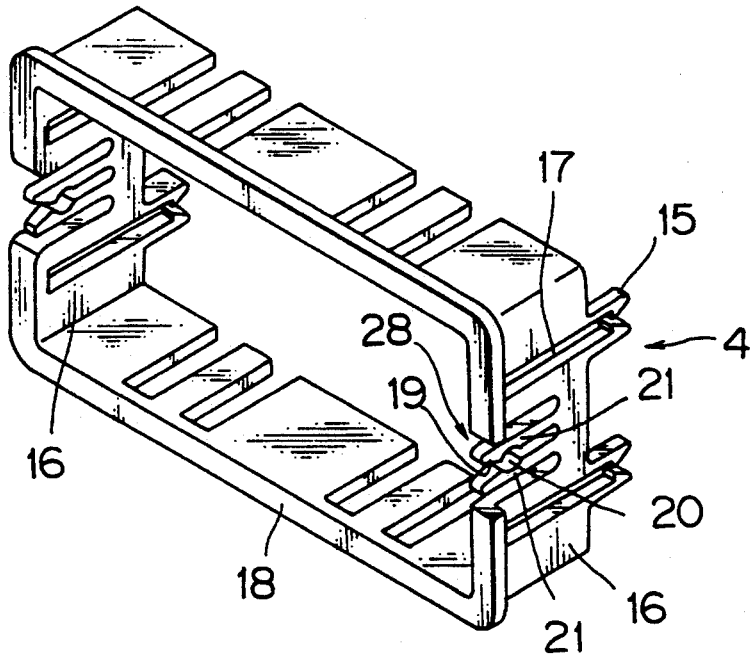
FIG. 5 is a perspective view of the protective cover.
Figure 6:
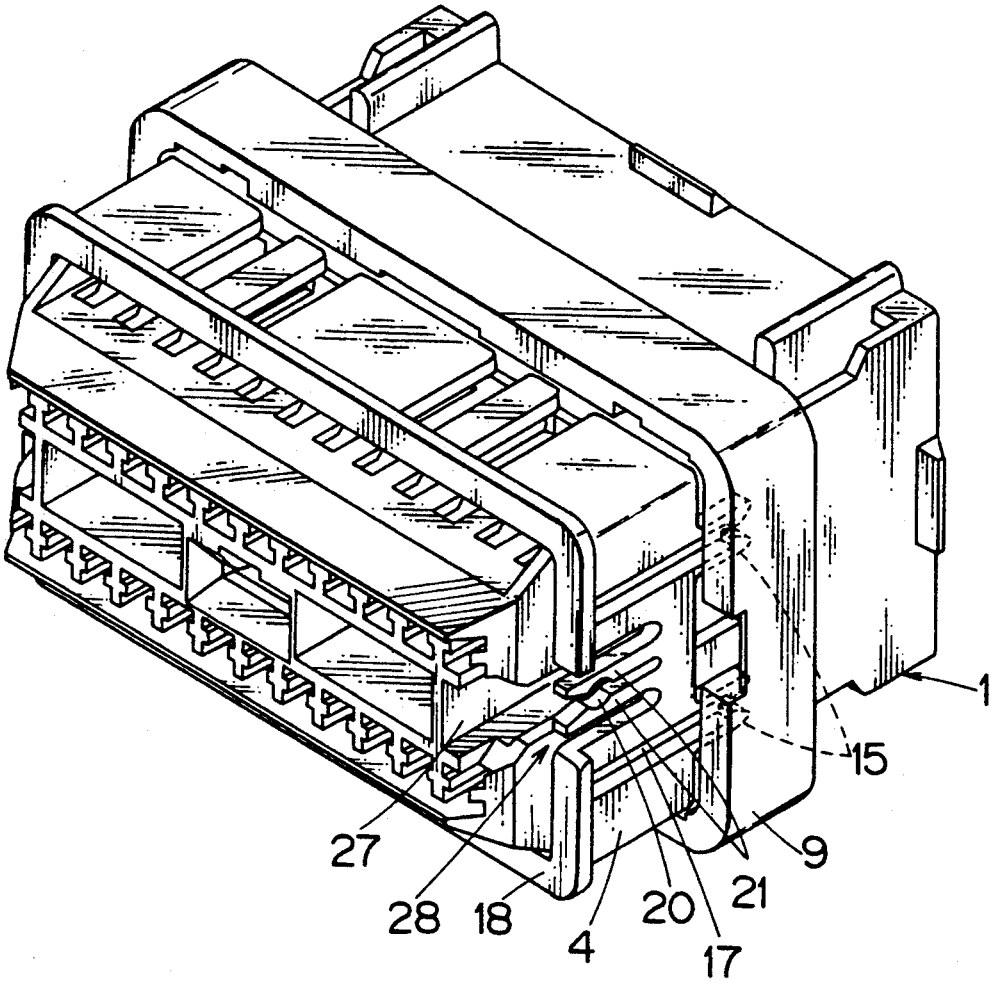
FIG. 6 is a perspective view of a male connector mounted with the protective cover.

FIG. 5 is a perspective view of the protective cover 4 and FIG. 6 is a perspective view of the male connector 1 mounted with the protective cover 4.

The protective cover 4 is made of a synthetic resin material and formed into a rectangular cylinder. The side walls 16, 16 of the protective cover 4 are each provided at the base end with two pairs of rearwardly extended, facing resilient engagement claws 15. Insertion guide slits 17, 17 are formed between the paired engagement claws 15 and into the side walls 16 to receive the locking projections 13, 14. The side walls 16 are formed at the front end with a flange 18 that comes into contact with the opening edge 8 of the female connector portion 6. Also, the side walls 16 are each provided with a drawing engagement portion 28 at the central portion thereof at the front side, which consists of a pair of facing flexible clamping pieces 21, 21 with a circular engagement groove 20 cut behind locking projections 19. The protective cover 4 is slidable on the connector housing 7 with the engagement projections 13, 14 in sliding contact with the insertion slits 17, 17.

Figure 7:
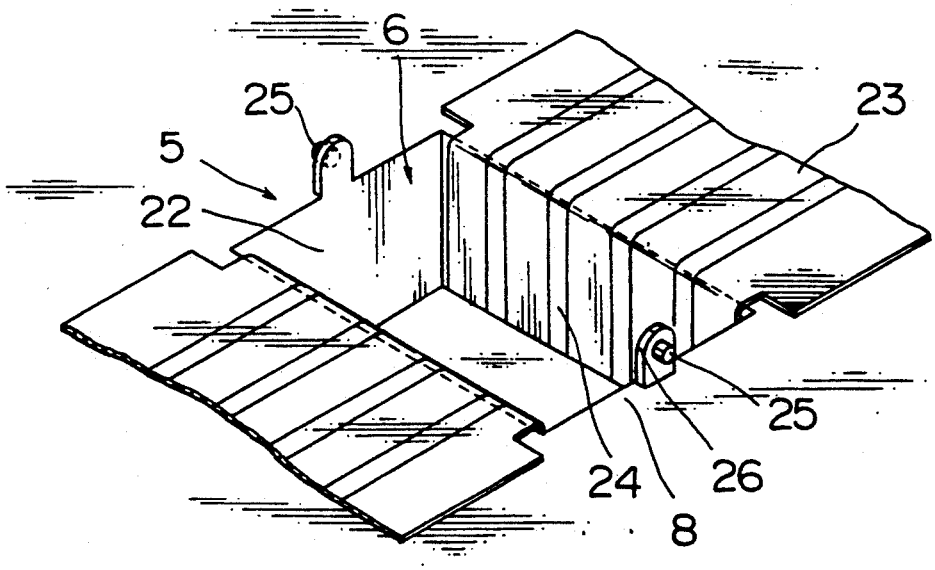
FIG. 7 is a perspective view of the mating female connector portion.
Figure 8:
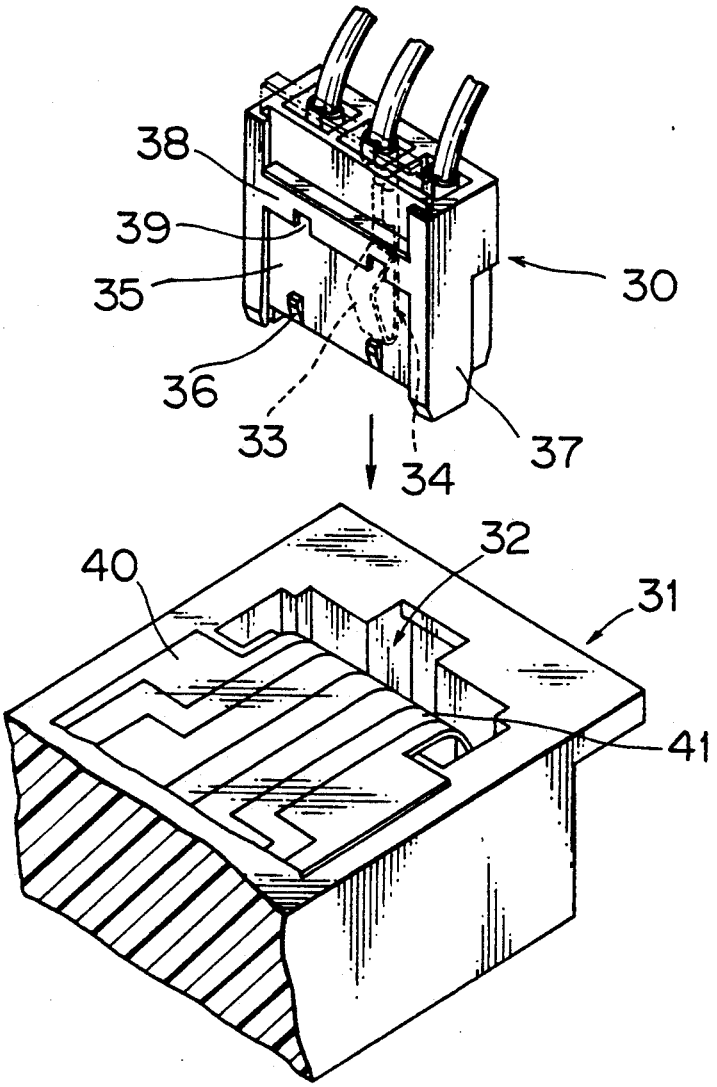
FIG. 8 PRIOR ART
FIG. 8 is an perspective view of a disassembled conventional connector.

The female connector portion 6, as shown also in FIG. 7, comprises: an exposed terminal portion 24 of the flexible printed circuit body 23 bent and installed in a cavity 22 formed in the meter case 5; and engagement portions 29 that engage with the engagement portions 28 of the protective cover 4 and which consist of ears 26 erected at the side edges 8 of the cavity opening and having locking pins 25 projecting therefrom.

As shown in FIG. 4, the male connector housing 7 is formed with insertion grooves 27 for the ears 26 to allow the male connector 1 to be inserted into the female connector portion 6 along the ears 26.

As shown in FIG. 2, the protective cover 4 is pushed by the engagement surface 14*c* of the locking projection 14 to cause the locking pins 25 of the ears 26 to slip into the engagement grooves 20 of the flexible clamping pieces 21. It is to be noted here that the force required to push the locking projection 14 through the engagement claws 15 is set larger than that required to push the locking pin 25 through the clamping pieces 21. With the flange 18 of the protective cover 4 in contact with the opening edge 8 of the female connector portion 6, the protective cover 4 is held and locked by a flange 9 of the male connector 1, as shown in FIG. 3.

In pulling out the male connector 1, the protective cover 4 remains covering the elastic contact pieces 3 of the exposed terminals 2 because the resilient clamping pieces 21 are left engaged with the locking pins 25. As the male connector is further pulled, the resilient clamping pieces 21 disengage from the locking pins 25, with the engagement surface 13*c* of the locking projection 13 still engaged with the engagement claws 15 (the force required to disengage the locking projection 13 is set larger than that required to disengage the locking pin 25), so that the connector is disconnected with the protective cover 4 drawn out.

As described above, this invention offers the advantage that when the connector is pulled out as during maintenance, the protective cover is drawn out to cover the exposed terminals, protecting the terminals from being scored or deformed, maintaining the terminal quality of the connector.

What is claimed is:

1. A terminal cover structure, comprising:

a connector;

a protective cover provided on the connector, slidable in a direction parallel to an axis of the connector to be drawn out to cover exposed terminals of the connector or to be retracted;

a mating connector which is matable with said connector;

a first engagement member provided on one of the protective cover and the mating connector;

a second engagement member provided on the other of the protective cover and the mating connector, the second engagement member being adapted to releasably engage with the first engagement member;

said terminal structure having a fully mating position wherein said connector and said mating connector are mated together and wherein said protective cover is in an open retracted position and wherein said first engagement member is engaged with said second engagement member;

said terminal structure also having a disconnected position wherein said connector and said mating connector are disconnected and wherein said protective cover is in a closed drawn out position and wherein said first engagement member is disengaged from said second engagement member;

said connector having a first locking surface which provides sufficient force against said protective cover to enable said first and second engagement members to engage one another as said terminal structure is moved into said fully mating position;

said connector having a second locking surface which provides sufficient force against said protective cover to enable said first and second engagement members to disengage from one another as said terminal structure is moved to said disconnected position;

wherein electrical connection between the exposed terminals of the connector and terminals of the mating connector is made in said fully mating position and is disconnected in said disconnected position with the protective cover drawn out to protect the exposed terminals.

2. A terminal cover structure as claimed in claim 1, wherein the first engagement member comprises a pair of resilient clamping pieces adapted to hold the second engagement member therebetween.

3. A terminal cover structure as claimed in claim 2, wherein the first engagement member is provided on the protective cover.

4. A terminal cover structure as claimed in claim 3, wherein the second engagement member comprises an ear projecting in a fitting direction with the protective cover, the ear having a locking pin projecting laterally therefrom and adapted to be held between the resilient clamping pieces of the first engagement member.

5. A terminal cover structure as claimed in claim 3, wherein the protective cover comprises a cylinder circumferentially provided on the connector.

6. A terminal cover structure for a connector comprising:

a protective cover provided on the connector, slidable in a direction parallel to an axis of the connector to be drawn out to cover exposed terminals of the connector or retracted;

a first engagement means provided to one of the protective cover and a mating connector;

a second engagement means provided to the other of the protective cover and the mating connector, the second engagement means adapted to engage with the first engagement means to draw out the protective cover;

wherein electrical connection between the exposed terminals of the connector and terminals of the mating connector is made with the protective cover retracted and the connector is disconnected from the mating connector with the protective cover drawn out to protect the exposed terminals;

wherein the first engagement means comprises a pair of resilient clamping pieces adapted to hold the second engagement means therebetween;

wherein the first engagement means is provided to the protective cover;

wherein the protective cover comprises a rectangular cylinder circumferentially provided on the connector; and further comprising a third engagement means provided to the connector and a fourth engagement means provided to the protective cover, the third and fourth engagement means engageable with each other to maintain the protective cover in the drawn-out condition and disengageable from each other with a force greater than that required for the first and second engagement means to be engaged with or disengaged from each other.

7. A terminal cover structure for a connector as claimed in claim 6, wherein the third engagement means comprises two spaced locking projections each including a respective bulged portion for engagement with the fourth engagement means, the bulged portions being shifted from each other in the direction parallel to the axis of the connector, while the fourth engagement means comprises two pairs of inwardly-directed claws aligned with each other.

8. A terminal cover structure for a connector as claimed in claim 7, wherein one of the bulged portions located forwardly of the other is formed like an arrowhead with a sloping surface at the front and a vertical engagement surface at the rear, and the other of the bulged portions formed like a reversely-directed arrowhead with a vertical engagement surface at the front and a sloping surface at the rear.

9. A terminal cover structure as claimed in claim 1, wherein said first and second locking surfaces are provided on two separate first and second locking members, respectively.

10. A terminal cover structure as claimed in claim 4, wherein said first and second locking members are generally arrowhead shaped and face in opposing directions to one another.

11. A terminal cover structure as claimed in claim 10, wherein said protective cover includes flexible engagement claws which engage said first and second locking members.

12. A terminal cover structure as claimed in claim 11, wherein said protective cover includes insertion guide slits provided between said engagement claws for receiving said locking members.

* * * * *